United States Patent [19]

Sarazen

[11] Patent Number: 4,468,045

[45] Date of Patent: Aug. 28, 1984

[54] ATTACHMENT SYSTEM FOR DETACHABLE ROLLER SKATES

[76] Inventor: Philip R. Sarazen, 4 Willow St., Ottawa, Ontario, Canada

[21] Appl. No.: 403,026

[22] Filed: Jul. 29, 1982

Related U.S. Application Data

[63] Continuation-in-part of Ser. No. 224,087, Jan. 12, 1982, abandoned.

[51] Int. Cl.[3] ..... A63C 1/18

[52] U.S. Cl. ..... 280/11.3; D21/226

[58] Field of Search ..... 280/11.3, 11.31, 87.04 A; 292/256.67, 256.69, 113, 247; 24/68 B, 68 SK, 70 SK, 280; D21/226

[56] References Cited

U.S. PATENT DOCUMENTS

| | | | |
|---|---|---|---|
| 18,685 | 11/1857 | Evans et al. | 280/11.31 |
| 407,559 | 7/1889 | Wells | 292/256.67 |
| 1,187,817 | 6/1916 | Collis | 280/11.3 |
| 3,325,824 | 6/1967 | Donegan | 24/68 B X |
| 3,729,779 | 5/1973 | Porth | 24/68 SK |
| 3,757,394 | 9/1973 | Turner | 24/281 |
| 4,073,356 | 2/1978 | Schlicht | 280/87.04 A X |
| 4,138,128 | 2/1979 | Criss | 280/87.04 A X |
| 4,351,537 | 9/1982 | Seidel | 280/11.3 X |

FOREIGN PATENT DOCUMENTS

| | | | |
|---|---|---|---|
| 2448914 | 9/1980 | France | 280/11.3 |
| 3951 | 9/1891 | Switzerland | 24/70 SK |

*Primary Examiner*—Joseph F. Peters, Jr.
*Assistant Examiner*—Michael Mar
*Attorney, Agent, or Firm*—Burke-Robertson, Chadwick & Ritchie

[57] ABSTRACT

The invention comprises, in a roller skate adapted to be secured to an article of footwear and including a base member having heel stops toward the rearward and thereof, a novel system for securing the skate to the footwear comprising at least one partly stiff band permanently mounted to the skate; each band being formed into a transverse loop across the skate and having sufficient stiffness to maintain the loop in approximate position when the footwear is removed from the skate and having sufficient springing tendency to positively expand the loop when tension on the loop is eased; and each band including adjustments whereby the diameter of the loops may be varied in tension while maintaining the integrity of the loops.

4 Claims, 5 Drawing Figures

ATTACHMENT SYSTEM FOR DETACHABLE ROLLER SKATES

This application is a continuation-in-part of application Ser. No. 224,087, filed Jan. 12, 1982, now abandoned.

This invention relates to roller skates of the detachable type and to means of attaching the skates to shoes and the like.

It is the case that there has been in recent years a great upsurge in the use of roller skates for recreational purposes. However, quite apart from its recreational uses, the roller skate offers considerable advantage as part of an integrated intracity transporation system. The use of roller skates to get to a subway stop or other mass transit facility provides a very desirable form of exercise while at the same time contributing to energy conservation and lack of pollution. The frustrating delays involved with traffic lights, parking and the like in normal traffic; and traffic jams at certain times, is avoided. In terms of speed the roller skate is only marginally slower than the bicycle but is of course very much more portable, particularly when thinking in terms of such use as going from one location, such as a residence, to a mass transportation facility, and then continuing, following use of the mass transit means, to a second location, such as an office.

BACKGROUND OF THE INVENTION

To date there has not been a detachable roller skate available which is entirely satisfactory. Earlier such skates which are purported to be attachable to a variety of footwear have consistently exhibited various problems of which the following are the most troublesome. First, these earlier models have not been able to properly secure the foot to the roller skate base sufficiently firmly to prevent relative motion between the foot and the base in the plane of the base. It has generally been the case that even where an initial snug and fairly immobile connection could be made, the skating motion rapidly led to a loosening of the connection. A second problem is that there has not been a skate available to date which can be attached to and detached from a shoe or the like sufficiently quickly. Finally, braking mechanisms have been inadequate to provide the required degree of safety.

The present invention is directed to the alleviation of the first two of these problems.

PRIOR ART

The applicant is aware of no prior art which is similar in detail to the present invention. There are known in the art a number of prior art skates which utilize straps to attach a skate to a shoe or the like. These generally include clamps for securing the skate to the sole of the footwear. An example of such a skate is that described in U.S. Pat. No. 2,139,699, issued Dec. 13, 1938 to H. R. Segal. As will be apparent from a review of this patent, the subject matter differs greatly from the present invention. U.S. Pat. No. 18,685, issued Nov. 24, 1857 to Evans et al, illustrates a further example of a detachable ice skate having some minor similarities to the present invention.

OBJECTS OF THE INVENTION

It is the object of the invention to provide an improved means of attaching a detachable roller skate to footwear, such as shoes or the like.

BRIEF SUMMARY OF THE INVENTION

The present invention utilizes a unique fastening system for roller skates which makes use of stiff bands to replace conventional leather or vinyl straps. The bands have sufficient springing tendency to positively expand the loops for the forward and rearward parts of the foot to maintain the loop when tension of the loops is slackened. This greatly facilitates ease of attachment of the skates. In addition, the stiffness of the bands enables a much firmer more stable attachment to be made of the skate to the shoe.

The invention provides, in a roller skate adapted to be secured to an article of footwear and including a base member having heel stops towards the rearward end thereof, a system for securing the said skate to the said footwear comprising at least one partly stiff band permanently mounted to the skate; each said band being formed into a transverse loop across said skate and having sufficient stiffness to maintain said loop in approximate position when the footwear is removed from the skate and having sufficient springing tendency to positively expand said loop when tension on said loop is eased; and each said band including adjustment means whereby the diameter of the said loops may be varied in tension while maintaining the integrity of the loop.

BRIEF DESCRIPTION OF THE DRAWINGS

In drawings which illustrate embodiments of the invention.

DETAILED DESCRIPTION OF THE INVENTION

Figure 1:
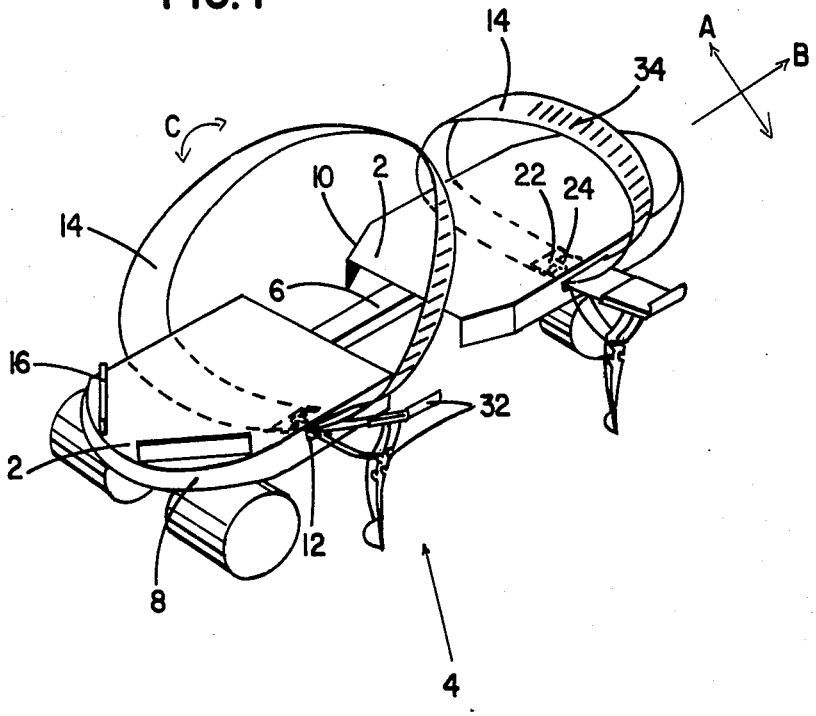
FIG. 1 is a perspective view showing a sketch of a roller skate carrying the securing system of the present invention.
Figure 2:
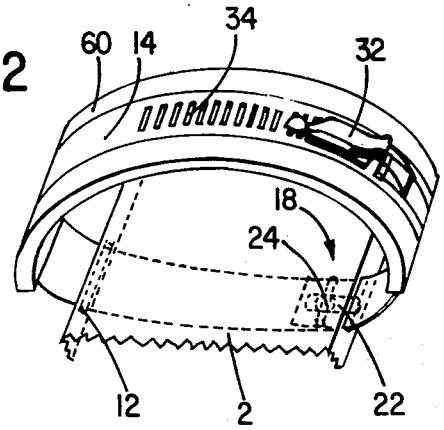
FIG. 2 is a perspective view of a securing system according to the invention.

With respect to FIG. 1, the two sections of the base 2 of the roller skate 4 are adjustable along the slide 6. The edges 8 and 10 of the base 2 are provided with slots 12 through which a loop is formed by the bands 14. Each band 14 is comprised of a material which is sufficiently stiff to be self-supporting in the loop shape and is also comprised of a material which has a sufficient spring characteristic to positively expand the loop when tension is eased.

Most preferably the band is of spring steel.

The raised members 16 provide a bumper against which the heel is seated when the skate is attached to a shoe or the like.

Figure 4:
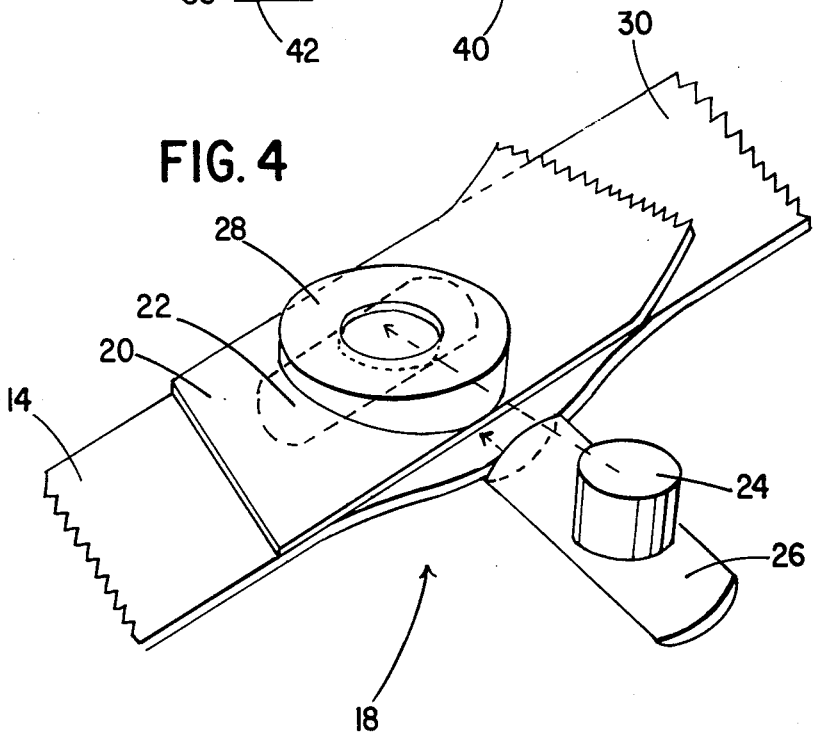
FIG. 4 is a perspective view of a connecting device, connecting one end of the band to a remote part of the band to form a loop.

One end of the band 14 is preferably though not necessarily attached to the base 2 by means of the connection 18 shown in detail in FIG. 4. The end 20 of band 14 is provided with an elongated opening 22 through which it is connected to the base 2 by means of the cylindrical projection 24. The projection 24 is carried on the supporting member 26 and is attached to base 2 by any convenient means. In a preferred embodiment the projection 24 is passed through an opening in the surface of base 2 after which the top of the said projection is expanded as by hammering to hold the projection loosely in position. Interposed between the end 20 of the strap 14 and the base 2 and disposed about projection 24 is the washer 28. The opposite end 30 of band 14 is provided with a buckling means 32 which interacts with a selected one of the holes 34 in the band 14 to secure the band.

The washer 28 is of varying thickness across its diameter, thus having its upper surface sloping from one side to the other across the washer. Thus, prior to tightening the band 14, the washer can be rotated about its seat on projection 24, in order to provide a smooth seat between the band 14 and the base 2, taking into account small variations of the band position as, for example, around the ankle of the user.

The elongated holes 22 permit some relative longitudinal movement of the end 20 of the band 14 when tightened, thus allowing for slight adjustment of the tension as the ankle changes position in skating.

It should be noted that the connection 18 on the one hand and the buckling means 32 on the other acting in combination with the slots 12 in the base 2 limit the extent to which the loop can be opened, thus insuring that the loop is always maintained when the band is unfastened so that the user can quickly step into the bands.

Figure 3:
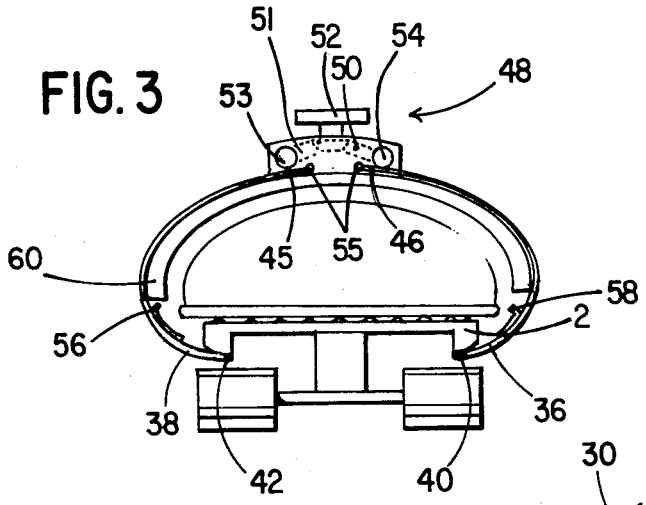
FIG. 3 is a front elevation of a sketch of a roller skate illustrating an embodiment of the securing system of the invention.

With reference to FIG. 3, there is shown an embodiment in which the ends 36 and 38 of the band are secured at 40 and 42 to the base 2. The other ends 45 and 46 of the band 14 are held in the adjustable fastening means 48. As shown in FIG. 3, the preferred fastening means for this embodiment is one utilizing a gear train connected to a thumbscrew to control tension in the strap. As illustrated, a pair of gears 50 and 51 are operatively connected on one side to the thumbscrew 52 and on the other side to the gears 53 and 54. These in turn interact with the end sections of the band 14. For this purpose the band 14 is provided with suitable receiving means to interact with the gears 53 and 54. Rotating the thumbscrew thus acts to tighten or loosen the band.

The enlargements 55 on the ends 45 and 46 of band 14 limit the movement of the strap within the fastening means 48.

The lateral support members 56 and 58 can if desired be provided on the lower portion the band ends 36 and 38 to ensure that there will be no kinking of the strap and to aid in preventing lateral movement of the shoe.

The bands 14 are in each case preferably provided with pad members 60 which act to cushion the pressure of the band and to aid in preventing undue movement of the foot within the bands.

The stiffness of the band 14, which, as indicated, is preferably of spring steel, combined with the gripping action of pads 60, provides a high degree of resistance to lateral movement of the shoe or the like when the band is tightened.

Figure 5:
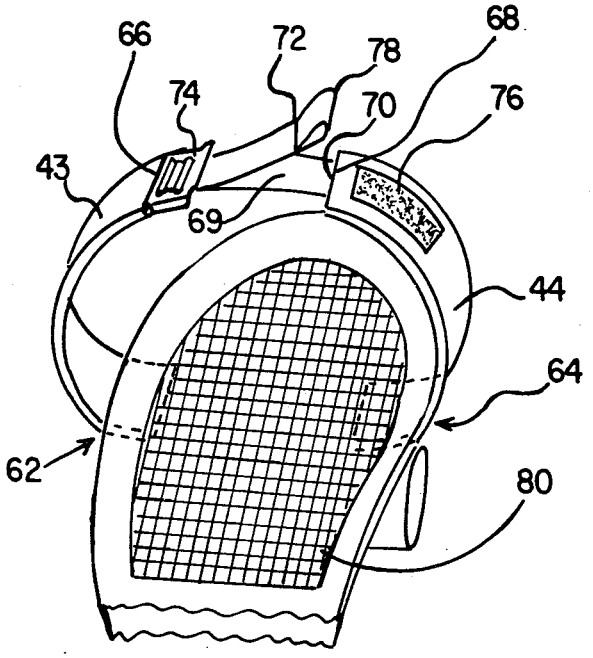
FIG. 5 is a perspective view of a further fastening means according to the invention.

The preferred embodiment illustrated in FIG. 5 shows a further method of attachment of the bands which will readily permit necessary adjustment but will prevent the tightened bands from working loose during use. The stiff band parts 43 and 44 are secured to the bottom of the skate platform at 62 and 64 respectively. The upper ends 66 and 68 of band parts 43 and 44 respectively are joined by the flexible strap 69. One end 70 of strap 69 is fixed to the end 68 of band part 44.

The opposite end 72 of strap 69 is fed through a fastening means 74 affixed to the end 66 of band part 43. The fastening means 74 allows for continuous adjustment of the tension in the strap 69 and band parts 43 and 44.

In order to ensure that movement of the fastening means caused by foot movement during skating does not allow the strap to work loose, a velcro type fastener is preferably utilized to join the free end 72 of the strap 69 to the band part 44. One part of the velcro fastener is illustrated at 76.

As in the earlier examples, the band parts 43 and 44 are constructed to have a sufficient springing tendency to exert a positive opening force on the overall fastening loop when tension on strap 69 is eased. The loop thus maintains its open shape to allow easy insertion and removal of the foot as necessary. The free end 72 of strap 69 may be looped as at 78 or otherwise provided with a stop to retain the strap 69 in the fastening means 74 for the sake of convenience.

FIG. 5 also illustrates a further preferred embodiment. The section of the skate platform located below the forward portion or ball of the foot as shown cross-hatched at 80 is preferably provided with an anti-slip surface comprising a roughening or grooving of the skate platform surface or the provision of an anti-slip paid on the surface. A rubber pad is preferred. The pad may also be roughened or grooved to further improve the anti-slip quality.

Thus it is apparent that there has been provided in accordance with the invention an attachment system for detachable roller skates that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. In a roller skate adapted to be secured to an article of footwear and including a base member having heel stops towards the rearward end thereof, a system for securing the said roller skate to the said footwear comprising:

at least one pair of partly stiff band sections of a spring material permanently mounted toward one end and on opposite sides of said base member and extending upwardly therefrom toward each other in a curved permanently upstanding configuration, the said band sections in each pair being joined to each other near the free ends thereof to form with the surface of the base member a continuously upstanding closed loop by a quick release adjustment means whereby the loop size may be varied while maintaining the integrity of the loop, wherein each said partly stiff band section is biased against closure of the said loop so as to positively expand the said loop when tension on the loop is eased by said quick release adjustment, and wherein said quick release adjustment means comprises an arrangement whereby one band section of each said pair includes at the end thereof a receptacle for a strap and the respective second band section of each pair includes a flexible strap adapted to engage said receptacle and turn back on itself where it is secured by a quick release fastener, whereby the said system allows a user of the roller-skate to simply step in and step out of an adjustable loop which loop is always presented in the said upstanding configuration.

2. The system of claim 1 wherein said at least one pair of band sections has associated therewith padded members covering a substantial part of the area of the bands which will contact said footwear and wherein said padded members are arranged so as not to inhibit said springing tendency.

3. The system of claim 1 wherein said quick release fastener comprises a velcro type fastening means.

4. The system of claim 1 wherein an anti-slip means is provided on top of the roller skate in the area under the ball of the foot, and said anti-slip means comprises a slip resistant surface on the skate.

* * * * *